US008171577B1

(12) United States Patent
Gutt

(10) Patent No.: US 8,171,577 B1
(45) Date of Patent: May 8, 2012

(54) BATHTUB SEAT SYSTEM

(76) Inventor: Michael F. Gutt, Burbank, IL (US)

( * ) Notice: Subject to any disclaimer, the term of this patent is extended or adjusted under 35 U.S.C. 154(b) by 651 days.

(21) Appl. No.: 12/323,131

(22) Filed: Nov. 25, 2008

(51) Int. Cl.
*A47K 3/022* (2006.01)

(52) U.S. Cl. ..... 4/578.1; 4/564.1; 4/565.1; 4/579; 4/611

(58) Field of Classification Search ..... 4/578.1, 4/579, 611, 564.1, 565.1; 297/118, 130, 297/183.1, 183.6, 452.22
See application file for complete search history.

(56) References Cited

U.S. PATENT DOCUMENTS

| | | | | | |
|---|---|---|---|---|---|
| 3,086,222 | A * | 4/1963 | Hall et al. | 4/659 |
| 3,346,885 | A * | 10/1967 | Merriman | 4/566.1 |
| 3,584,320 | A * | 6/1971 | Locke | 4/578.1 |
| 3,771,176 | A * | 11/1973 | Herman, Sr. | 4/578.1 |
| 3,835,483 | A * | 9/1974 | Emery et al. | 4/579 |
| 3,875,597 | A * | 4/1975 | McGaffin et al. | 4/578.1 |
| 4,254,517 | A * | 3/1981 | Herman, Jr. | 4/564.1 |
| 4,385,408 | A * | 5/1983 | Rhodes | 4/523 |
| 4,495,666 | A * | 1/1985 | Herman, Jr. | 4/564.1 |
| 4,534,074 | A * | 8/1985 | Herman, Jr. | 4/564.1 |
| 5,090,068 | A * | 2/1992 | Zellner | 4/578.1 |
| 5,333,322 | A * | 8/1994 | Weir | 4/496 |
| 5,448,787 | A * | 9/1995 | Allen | 4/559 |
| 5,829,070 | A * | 11/1998 | Taylor | 4/578.1 |
| 5,855,028 | A * | 1/1999 | Colbert | 4/566.1 |
| 5,896,598 | A * | 4/1999 | Jeans | 4/566.1 |
| 6,134,723 | A * | 10/2000 | Benson | 4/579 |
| 6,378,147 | B1 * | 4/2002 | Halleran | 4/579 |
| 6,691,337 | B1 * | 2/2004 | Banks | 4/575.1 |
| 6,715,164 | B2 * | 4/2004 | Steadman et al. | 4/566.1 |
| 6,804,842 | B1 * | 10/2004 | Johnson | 4/578.1 |
| 2005/0076431 | A1 * | 4/2005 | Reynolds et al. | 4/579 |

* cited by examiner

*Primary Examiner* — Brian Glessner
*Assistant Examiner* — Joshua Ihezie

(57) ABSTRACT

A bathtub seat system a bathtub that has a bottom wall and a perimeter wall that is attached to and extends upwardly from the bottom wall. The perimeter wall includes a pair of lateral walls attached to and extending upwardly from the bottom wall. The perimeter wall has an upper edge defining an opening extending into the bathtub. A block is removably positioned in the bathtub and has a bottom side, a top side and a peripheral surface extending between the top and bottom sides. The peripheral surface includes a front side, a back side, a first lateral side, and a second lateral side. A width of the block from the first lateral side to the second lateral side increases from the bottom side to the top side. The block extends between and frictionally engages the lateral walls. The block provides a seating space for a person using the bathtub.

7 Claims, 5 Drawing Sheets

BATHTUB SEAT SYSTEM

BACKGROUND OF THE INVENTION

Field of the Invention

The present invention relates to bathtub seat devices and more particularly pertains to a new bathtub seat device to allow a person to comfortably sit in a bathtub in an upright position.

SUMMARY OF THE INVENTION

The present invention meets the needs presented above by generally comprising a bathtub that has a bottom wall and a perimeter wall that is attached to and extends upwardly from the bottom wall. The perimeter wall includes a pair of lateral walls attached to and extending upwardly from the bottom wall. The perimeter wall has an upper edge defining an opening extending into the bathtub. A block is removably positioned in the bathtub and has a bottom side, a top side and a peripheral surface extending between the top and bottom sides. The peripheral surface includes a front side, a back side, a first lateral side, and a second lateral side. A width of the block from the first lateral side to the second lateral side increases from the bottom side to the top side. The block extends between and frictionally engages the lateral walls. The block provides a seating space for a person using the bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
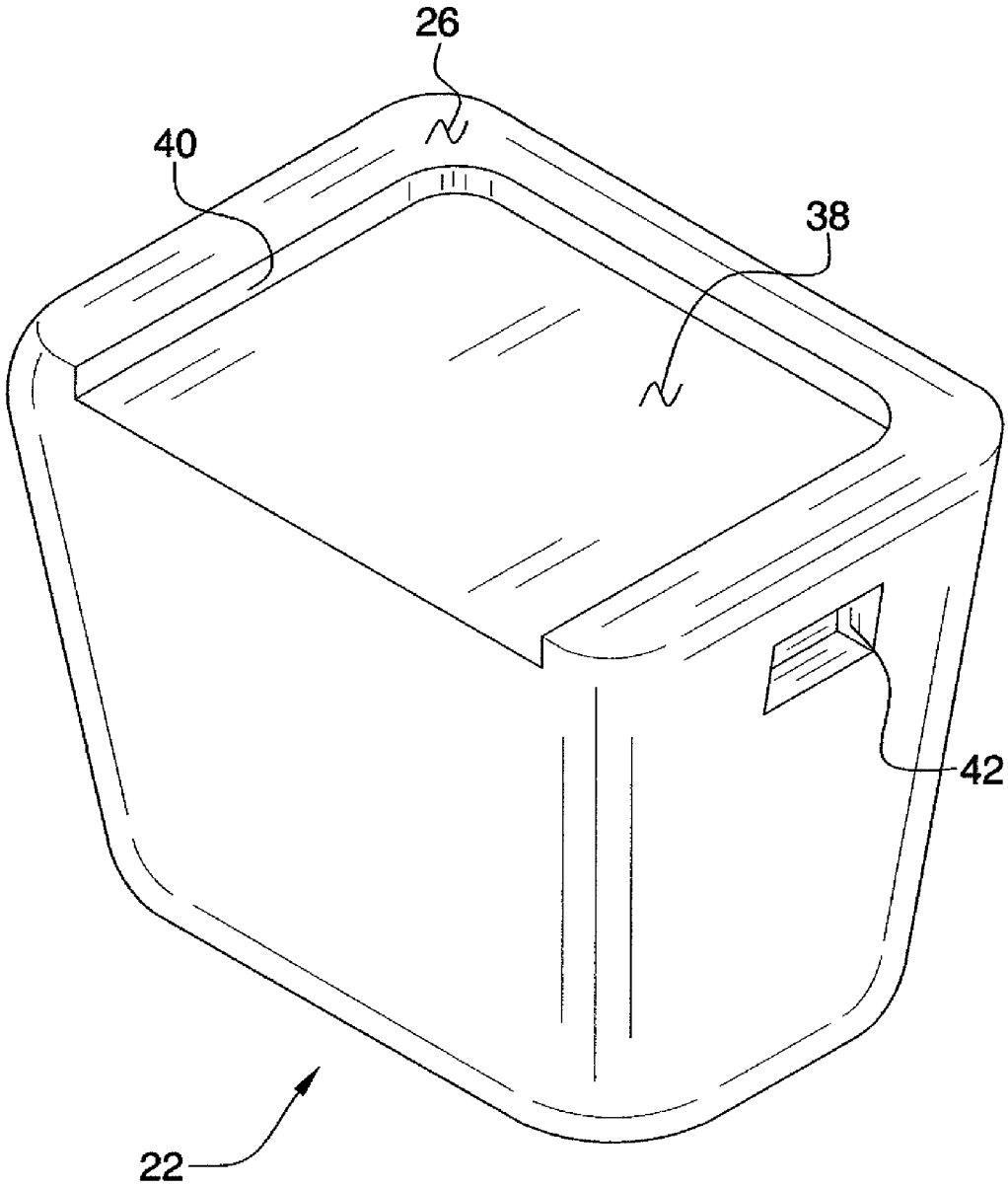
FIG. 1 is a top perspective view of a block of a bathtub seat system according to the present invention.
Figure 2:
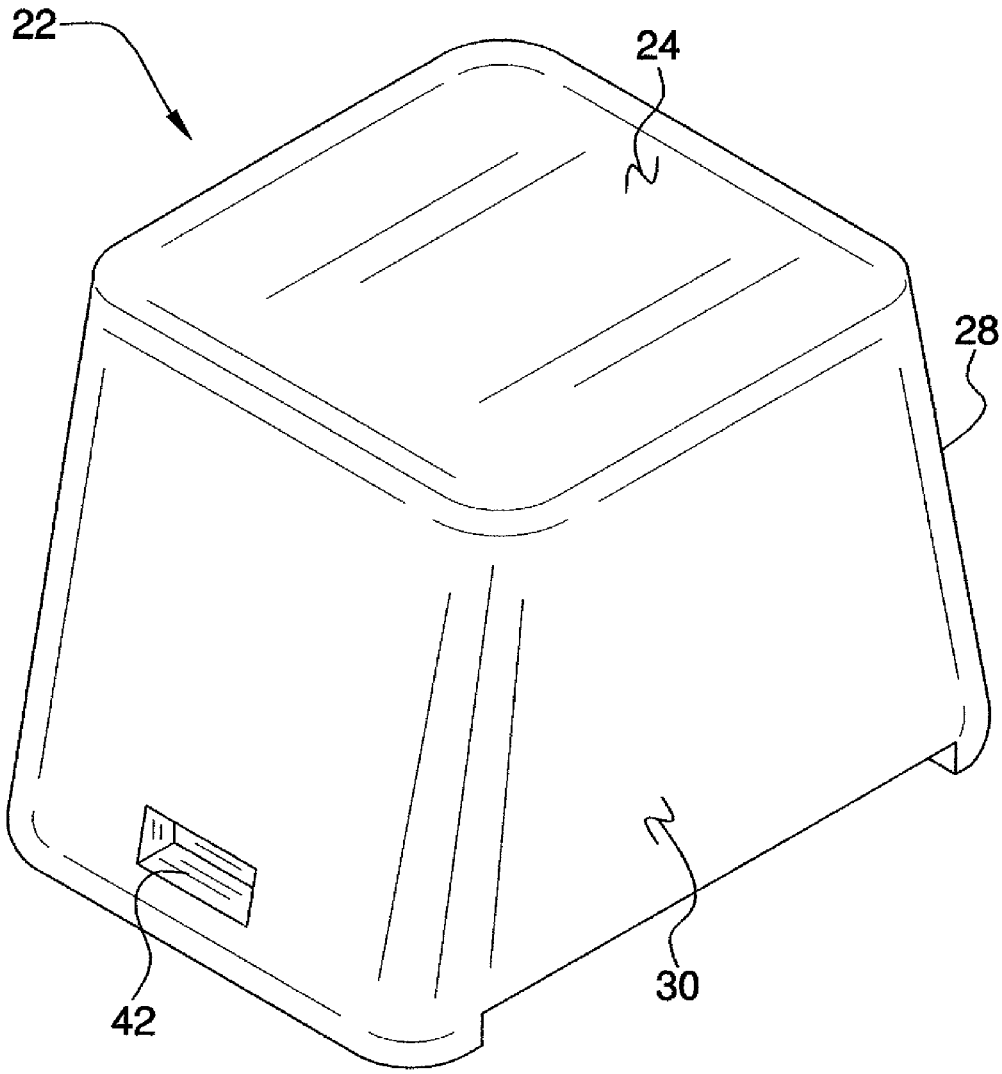
FIG. 2 is a bottom perspective view the block of the present invention.
Figure 3:
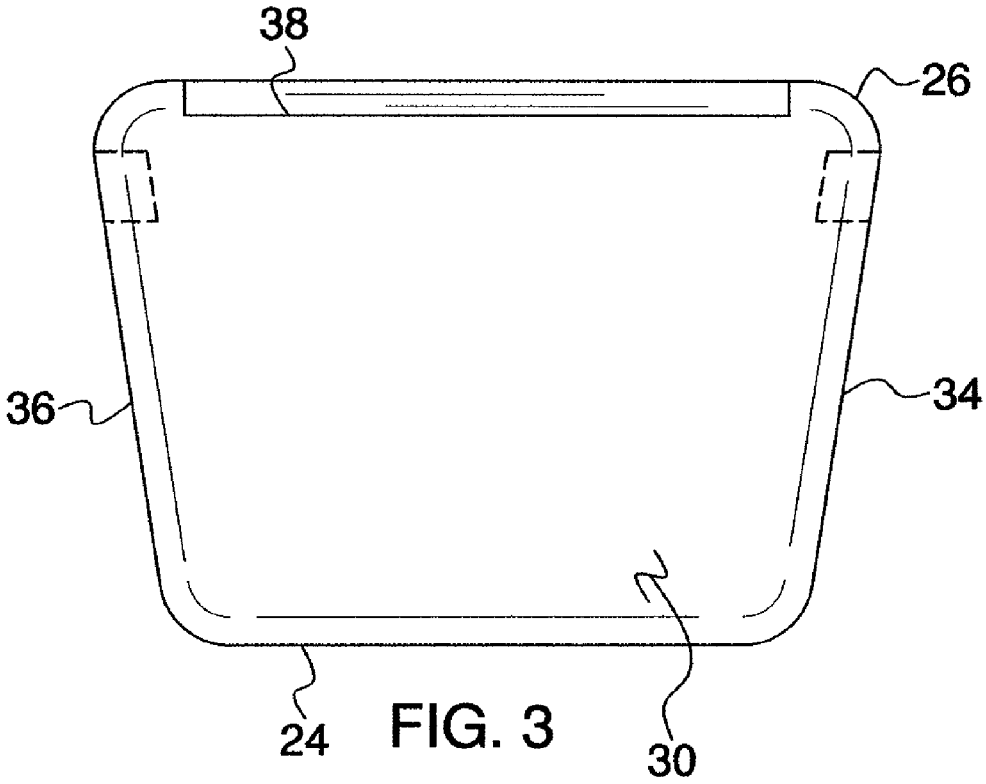
FIG. 3 is a front view of the block of the present invention.
Figure 4:
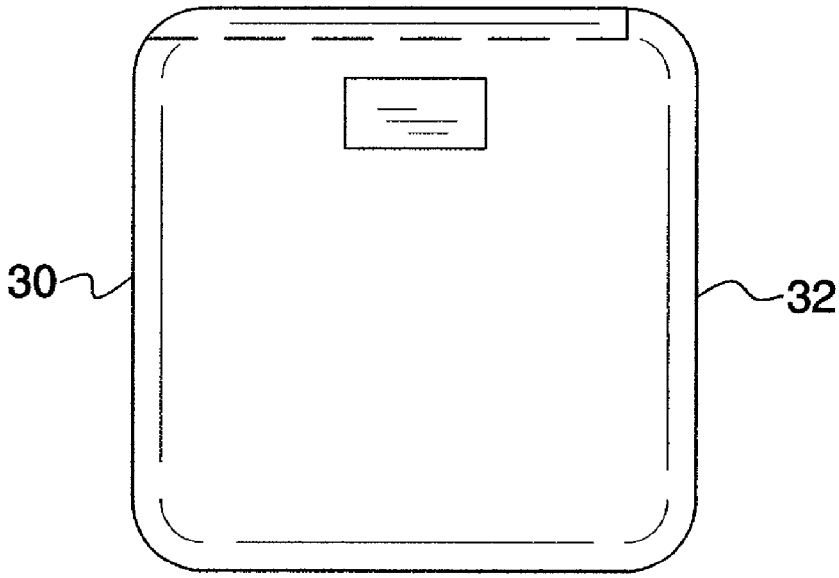
FIG. 4 is a side view of the block of the present invention.
Figure 5:
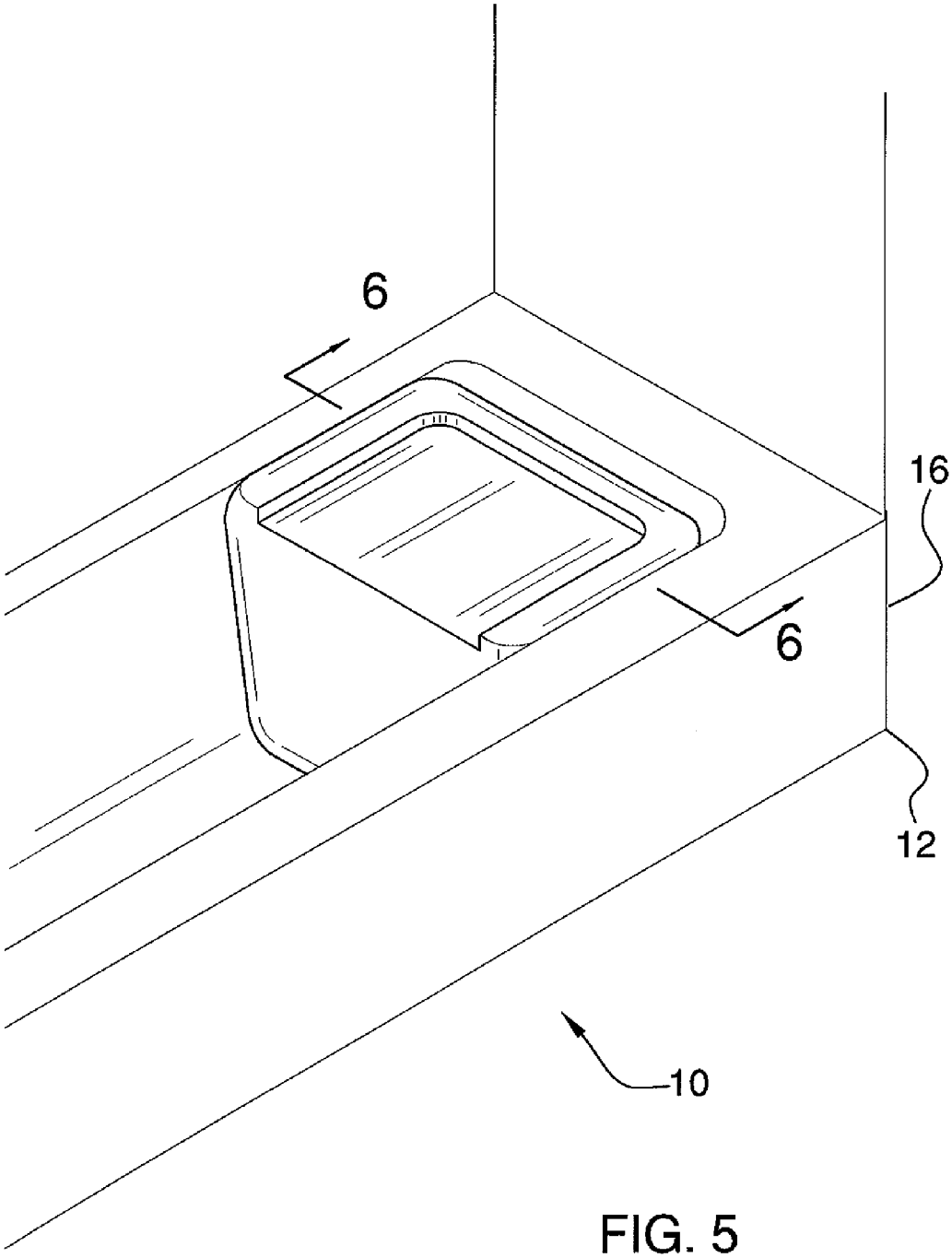
FIG. 5 is a top perspective view of the present invention.

With reference now to the drawings, and in particular to FIGS. 1 through 6 thereof, a new bathtub seat device embodying the principles and concepts of the present invention and generally designated by the reference numeral 10 will be described.

As best illustrated in FIGS. 1 through 6, the bathtub seat system 10 generally comprises a conventional bathtub 12 that has a bottom wall 14 and a perimeter wall 16 that is attached to and extends upwardly from the bottom wall 14. The perimeter wall 16 includes a pair of lateral walls 18 attached to and extending upwardly from the bottom wall 14. The perimeter wall 16 has an upper edge 20 defining an opening extending into the bathtub 12. The lateral walls 18 angle outwardly away from each other and the bottom wall 14 to the upper edge 20.

Figure 6:
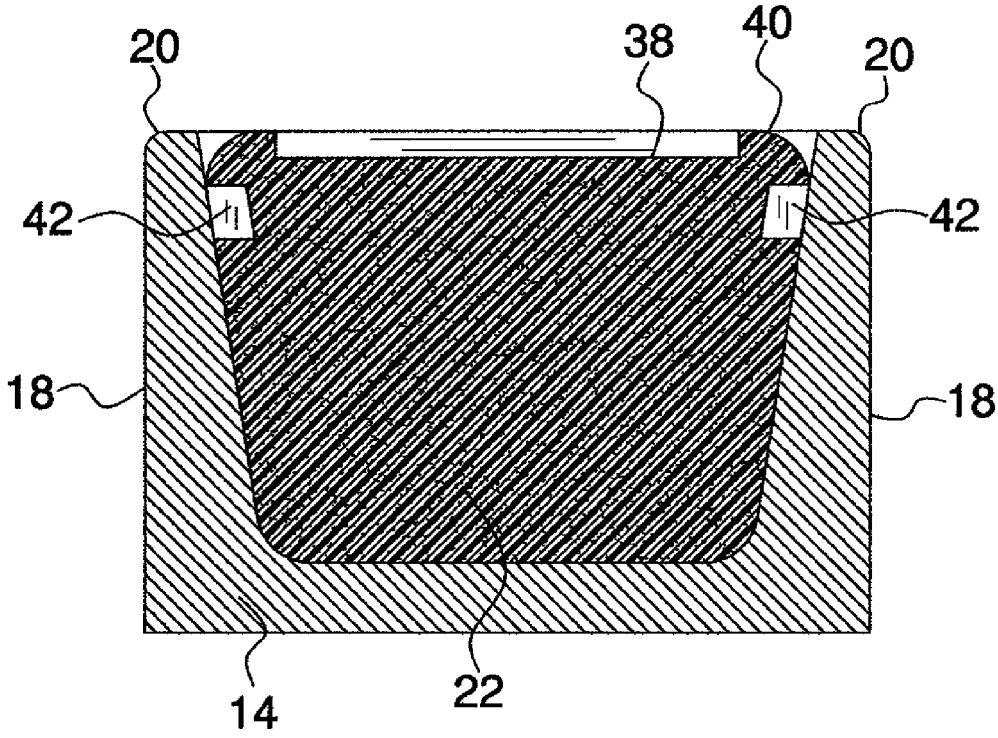
FIG. 6 is a cross-sectional view taken along line 6-6 of FIG. 5 of the present invention.

A block 22 is removably positioned in the bathtub 12. The block 22 may be solid as shown in FIG. 6 and has a bottom side 24, a top side 26 and a peripheral surface 28 extending between the top 26 and bottom 24 sides. The peripheral surface 28 includes a front side 30, a back side 32, a first lateral side 34, and a second lateral side 36. A width of the block 22 from the first lateral side 34 to the second lateral side 36 increases from the bottom side 24 to the top side 26. The width is greater than a width of the bathtub 12 extending between the lateral walls 18. The block 22 has a height from the top side 26 to the bottom side 28 approximately equal to a height of the bathtub 12 from its bottom wall 14 to the upper edge 20. The block 22 has a depth from the front side 30 to the back side 32 of at least 18 inches and may have a depth up to 36 inches.

The block 22 is comprised of a resiliently compressible material to frictionally engage the bathtub 12 when the bottom side 24 is a butted against the bottom wall 14 and the first 34 and second 36 lateral sides abut against corresponding ones of the lateral walls 18. The block 22, having a greater width than the width of the bathtub 12, is wedged into place to prevent its unwanted movement during usage thereof. The resiliently compressible material may be a foamed elastomer or a foamed plastic.

The top side 26 has a depression 38 therein that extends through a juncture of the front side 30 and the top side 26 to form a seat. A shoulder 40 is defined between the depression 38 and the backside 32, first lateral side 34, and second lateral side 36. A width of the shoulder 40, along its length, from the peripheral surface 28 to the depression 38 is less than 3 inches. The depression 38 has a height less than 6 inches from an upper service of the depression 38 to the top side 26.

Each of the first 34 and second 36 lateral sides has a notch 42 therein. The notch 42 in each of the first 34 and second 36 lateral sides is positioned nearer to the top side 36 than the bottom side 24 to allow gripping of the block 22 to position the block 22 in or remove the block 22 from the bathtub 12. The notches 42 are reached by extending a hand between the perimeter wall 16 of the bathtub 12 and the block 22 to compress the block 22 to reach the notches 42.

In use, the block 22 is positioned in a bathtub 12, preferably opposite a faucet positioned in the bathtub 12, to provide a seating space for a person using the bathtub 12. This block 22 may be used for convenience reasons or may be used by disabled persons or persons having difficulty moving to more easily use a bathtub 12. The block 22 may include a water impermeable coating to prevent the block 22 from becoming wet or saturated with water.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathtub seat system comprising:

a bathtub having a bottom wall and a perimeter wall being attached to and extending upwardly from said bottom wall, said perimeter wall including a pair of lateral walls being attached to and extending upwardly from said bottom wall, said perimeter wall having an upper edge defining an opening extending into said bathtub;

a block being removably positioned in said bathtub and having a bottom side, a top side and a peripheral surface extending between said top and bottom sides, said peripheral surface including a front side, a back side, a first lateral side, and a second lateral side, a width of said block from said first lateral side to said second lateral side increasing from said bottom side to said top side, said block extending between and frictionally engaging said lateral walls;

each of said first and second lateral sides having a notch therein, said notch in each of said first and second lateral sides being positioned nearer to said top side than said bottom side to allow gripping of said block to position said block in or remove said block from said bathtub;

each of said first and second lateral sides including an upper half adjacent to said top side and a lower half adjacent to said bottom side, said notch on each of said first and second lateral sides being completely positioned within said upper half of a respective one of said first and second lateral walls such that a remaining portion of each of said first and second lateral sides is flat and lies in a plane extending between said top and bottom sides; and wherein said block provides a seating space for a person using said bathtub.

2. The system according to claim 1, wherein said lateral walls angle outwardly away from each other and said bottom wall to said upper edge, said width being greater than a width of said bathtub extending between said lateral walls, said block being comprised of a resiliently compressible material to frictionally engage said bathtub when said bottom side is abutted against said bottom wall and said first and second lateral sides abut against corresponding ones of said lateral walls.

3. The system according to claim 1, wherein said top side has a depression therein, said depression extending through a juncture of said front side and said top side, a shoulder being defined between said depression and said backside, first lateral side, and second lateral side.

4. The system according to claim 3, wherein a width of said shoulder from said peripheral surface to said depression is less than 3 inches, said depression having a height less than 6 inches from an upper surface of said depression to said top side.

5. The system according to claim 1, wherein said block has a height from said top side to said bottom side approximately equal to a height of said bathtub from said bottom wall to said upper edge.

6. The system according to claim 3, wherein said block has a height from said top side to said bottom side approximately equal to a height of said bathtub from said bottom wall to said upper edge.

7. A bathtub seat system comprising:

a bathtub having a bottom wall and a perimeter wall being attached to and extending upwardly from said bottom wall, said perimeter wall including a pair of lateral walls being attached to and extending upwardly from said bottom wall, said perimeter wall having an upper edge defining an opening extending into said bathtub, said lateral walls angling outwardly away from each other and said bottom wall to said upper edge;

a block being removably positioned in said bathtub and having a bottom side, a top side and a peripheral surface extending between said top and bottom sides, said peripheral surface including a front side, a back side, a first lateral side, and a second lateral side, a width of said block from said first lateral side to said second lateral side increasing from said bottom side to said top side, said width being greater than a width of said bathtub extending between said lateral walls;

said block being comprised of a resiliently compressible material to frictionally engage said bathtub when said bottom side is abutted against said bottom wall and said first and second lateral sides abut against corresponding ones of said lateral walls, said resiliently compressible material being a foamed elastomer;

said top side having a depression therein, said depression extending through a juncture of said front side and said top side, a shoulder being defined between said depression and said backside, first lateral side, and second lateral side, a width of said shoulder from said peripheral surface to said depression being less than 3 inches, said depression having a height less than 6 inches from an upper service surface of said depression to said top side;

each of said first and second lateral sides having a notch therein, said notch in each of said first and second lateral sides being positioned nearer to said top side than said bottom side to allow gripping of said block to position said block in or remove said block from said bathtub;

each of said first and second lateral sides including an upper half adjacent to said top side and a lower half adjacent to said bottom side, said notch of each of said first and second lateral sides being completely positioned within said upper half of a respective one of said first and second lateral walls such that a remaining portion of each of said first and second lateral sides is flat and lies in a plane extending between said top and bottom sides;

said block having a height from said top side to said bottom side approximately equal to a height of said bathtub from said bottom wall to said upper edge; and wherein said block provides a seating space for a person using said bathtub.

* * * * *